US010105821B2

(12) United States Patent
Mejean et al.

(10) Patent No.: US 10,105,821 B2
(45) Date of Patent: Oct. 23, 2018

(54) ABRASIVE ARTICLE AND METHOD OF FORMING

(71) Applicants: Saint-Gobain Abrasives, Inc., Worcester, MA (US); Saint-Gobain Abrasifs, Conflans-Sainte-Honorine (FR)

(72) Inventors: Cecile O. Mejean, Marlborough, MA (US); Srinivasan Ramanath, Holden, MA (US); Ramanujam Vedantham, Worcester, MA (US); John M. Gulcius, Shrewsbury, MA (US); Rachana Upadhyay, Shrewsbury, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 753 days.

(21) Appl. No.: 14/579,531

(22) Filed: Dec. 22, 2014

(65) Prior Publication Data

US 2015/0183086 A1 Jul. 2, 2015

Related U.S. Application Data

(60) Provisional application No. 61/922,231, filed on Dec. 31, 2013.

(51) Int. Cl.
*B24D 3/10* (2006.01)
*B24D 3/34* (2006.01)

(52) U.S. Cl.
CPC ..... *B24D 3/10* (2013.01); *B24D 3/346* (2013.01)

(58) Field of Classification Search
CPC ... B24D 3/00; B24D 3/04; B24D 3/06; B24D 3/10; B24D 3/18; B24D 3/26; B24D 3/28;
(Continued)

(56) References Cited

U.S. PATENT DOCUMENTS 4,362,535 A 12/1982 Isobe et al.
6,375,692 B1 4/2002 Manwiller et al.
(Continued)

FOREIGN PATENT DOCUMENTS

JP 2000233374 A 8/2000
JP 2004148469 A 5/2004
(Continued)

OTHER PUBLICATIONS

International Search Report from PCT/US2014/071935 dated Mar. 20, 2015, 1 page.

*Primary Examiner* — Jennifer A Smith
*Assistant Examiner* — Alexandra M Moore
(74) *Attorney, Agent, or Firm* — Abel Law Group, LLP; Joseph P. Sullivan

(57) ABSTRACT

A bonded abrasive article suitable for processing hard materials such as sapphire. In an embodiment, an abrasive article includes a bonded abrasive body including a bond material comprising a metal, abrasive particles contained within the bond material having an average particle size of not greater than about 20 μm, and a pore size standard deviation of not greater than about 16 μm. An abrasive article can also include a bonded abrasive body having a bond material comprising metal, abrasive particles contained within the bond material having an average particle size of not greater than about 20 μm, and an average pore size of not greater than about 110 μm.

15 Claims, 4 Drawing Sheets

| Sample | N | Mean | StDev | Minimum | Q1 | Median | Q3 | Maximum |
|---|---|---|---|---|---|---|---|---|
| C1 | 80 | 117.37 | 18.90 | 88.71 | 103.83 | 114.25 | 126.34 | 170.70 |
| S1 | 80 | 84.543 | 6.16 | 75.269 | 80.645 | 80.645 | 88.71 | 111.559 |

(58) Field of Classification Search
CPC ... B24D 3/32; B24D 5/00; B24D 7/00; B24D 11/00; B24D 18/00; B24D 99/00; B24D 99/005; C09K 3/14; C09K 3/1436; C09K 3/1463; B32B 2266/102; B32B 2266/104; B32B 2266/106; B32B 2266/108; B32B 2305/00; B32B 2305/02; B01J 2219/00423
See application file for complete search history.

(56) References Cited

U.S. PATENT DOCUMENTS

| | | | | |
|---|---|---|---|---|
| 6,685,755 | B2 | 2/2004 | Ramanath et al. | |
| 2003/0232586 | A1 | 12/2003 | Ramanath et al. | |
| 2008/0222967 | A1* | 9/2008 | Querel ..... | B24D 3/18 51/308 |
| 2009/0084042 | A1 | 4/2009 | Ramanath et al. | |
| 2010/0000159 | A1 | 1/2010 | Walia et al. | |

FOREIGN PATENT DOCUMENTS

| | | | |
|---|---|---|---|
| TW | 515741 | B | 1/2003 |
| TW | 200300378 | A | 6/2003 |
| WO | 01/85393 | A1 | 11/2001 |

* cited by examiner

| Sample | N | Mean | StDev | Minimum | Q1 | Median | Q3 | Maximum |
|---|---|---|---|---|---|---|---|---|
| C1 | 8 | 66.46 | 2.97 | 64.36 | 66.54 | 67.6 | 71.07 | 73.58 |
| S1 | 8 | 68.34 | 2.83 | 65.47 | 65.47 | 68.17 | 71.26 | 72.37 |

| Sample | N | Mean | StDev | Minimum | Q1 | Median | Q3 | Maximum |
|---|---|---|---|---|---|---|---|---|
| C1 | 80 | 117.37 | 18.90 | 88.71 | 103.83 | 114.25 | 126.34 | 170.70 |
| S1 | 80 | 84.543 | 6.16 | 75.269 | 80.645 | 80.645 | 88.71 | 111.559 |

ABRASIVE ARTICLE AND METHOD OF FORMING

CROSS-REFERENCE TO RELATED APPLICATION(S)

This application claims priority under 35 U.S.C. § 119(e) to U.S. Patent Application No. 61/922,231 entitled "Abrasive Article and Method of Forming," by Cecile O. Mejean et al., filed Dec. 31, 2013. which is assigned to the current assignee hereof and incorporated herein by reference in its entirety.

BACKGROUND

Field of the Disclosure

The following is directed to abrasive articles, and particularly, to bonded abrasive articles suitable for processing hard materials such as sapphire.

Description of the Related Art

The use of porous abrasives to improve mechanical grinding processes is generally well known. Pores typically provide access to grinding fluids, such as coolants and lubricants, which tend to promote more efficient cutting, minimize metallurgical damage (e.g., surface burn), and maximize tool life. Pores also permit the clearance of material (e.g., chips or swarf) removed from an object being ground.

Bonded abrasive tools are particularly useful in grinding and polishing hard materials, such as single crystal materials typically used in electronics and optics industries. For example, one such material is sapphire, used as windows for infrared and microwave systems, optical transmission windows for ultraviolet to near infrared light, light emitting diodes, ruby lasers, laser diodes, and even as substrates for microelectronic integrated circuit applications, growth of superconducting compounds, and formation of semiconducting materials, such gallium nitride and the like.

Grinding and polishing of single crystal materials, such as sapphire, is an extremely slow and laborious process. Aggressive abrasive processes and materials must be utilized to achieve acceptable polishing rates, and yet such processes put the integrity of the single crystal material at risk for damage and contamination.

Accordingly, a need exists for improved abrasive articles for grinding and polishing hard, single crystal materials such as sapphire.

SUMMARY

In one aspect, an abrasive article includes a bonded abrasive body including a bond material comprising a metal, abrasive particles contained within the bond material having an average particle size of not greater than about 20 μm, and a pore size standard deviation of not greater than about 16 μm.

In another aspect, an abrasive article includes a bonded abrasive body having a bond material comprising metal, abrasive particles contained within the bond material having an average particle size of not greater than about 20 μm, and an average pore size of not greater than about 110 μm.

In yet another aspect, an abrasive article includes a bonded abrasive body having a bond material comprising a metal, abrasive particles contained within the bond material, and a ratio of wear rate ($mm^3/N$) to flexural strength (MPa) of at least about 5.

In yet another aspect, an abrasive article can include a bonded abrasive body including a bond material comprising a metal, abrasive particles contained within the bond material, and a ratio of wear rate ($mm^3/N$) to maximum compression load (N) of at least about 0.025.

In yet another aspect, an abrasive article includes a bonded abrasive body having a bond material comprising a metal, abrasive particles contained within the bond material, an average pore size of not greater than about 110 μm. and a pore size standard deviation of not greater than about 16 μm.

The foregoing has outlined rather broadly and in a non-limiting fashion the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the scope of the invention as set forth in the appended claims.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1:
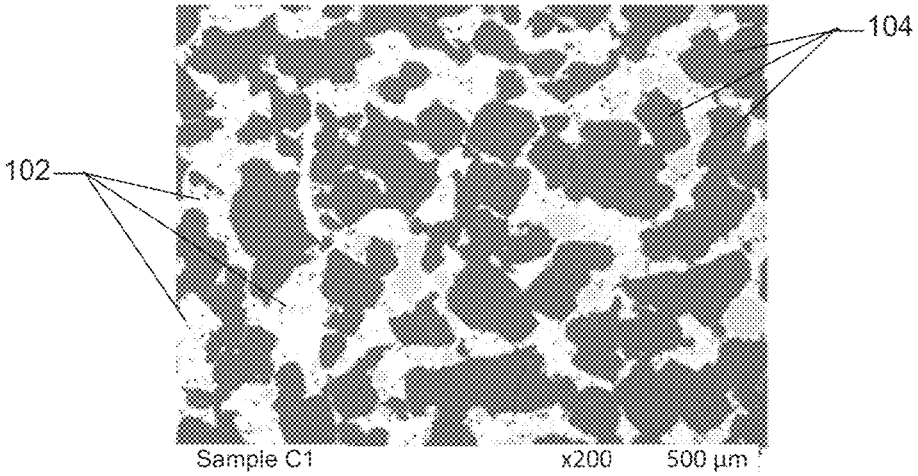
FIG. 1 includes an SEM photograph of a conventional abrasive article.

The following is directed to abrasive articles, and more particularly, bonded abrasive articles, including abrasive particles contained within a volume of bond material. Furthermore, the abrasive particles of the embodiments herein may contain some content of porosity. The abrasive articles of the embodiments herein may be suitable for use in material removal operations, including for example, material removal operations on substrates or wafers, and more particularly, substrates or wafers of hard materials, such as sapphire.

Formation of the abrasive article in accordance with the embodiments herein may be facilitated by combining certain components together and forming a mixture. Such components may include permanent components, which may be present in the original mixture and in the finally-formed abrasive article, such as abrasive particles, bond material, and the like. The permanent components may undergo some changes during processing, such as changes to composition. Other components may include temporary components, wherein such temporary components may be present in the initial mixture but may not necessarily be present in the finally-formed abrasive article. Examples of some temporary components can include fillers, such as pore-forming materials. Moreover, the mixture may be a dry or wet mixture. It will be appreciated that in certain wet mixtures, additives may be provided to facilitate suitable dispersion of the components within each other.

After forming the mixture, the mixture may be formed into a green body. Suitable forming processes for the creation of a green body may include molding, casting, pressing, deposition, printing, and a combination thereof.

After suitably forming the green body, the green body can be converted to be a finally-formed abrasive article by utilizing one or more treatments. Suitable treatments can include, but are not limited to, heating, drying, sintering, cooling, pressing, and a combination thereof. In at least one embodiment, the green body can be formed into the finally formed abrasive article using a hot pressing operation, wherein the green body is heated to a temperature of at least about 350° C. to 650° C. Furthermore, during the cold pressing operation, the green body may be compacted under a particular force, which can be at least about 0.5 tons/in$^2$.

In one particular aspect, the method of forming the bonded abrasive body can include providing an initial mixture including a bond material or bond precursor materials, abrasive particles, and a filler including a dispersoid material. In a particular embodiment, the dispersoid material can have a certain particle size distribution. For example, in one embodiment, the particle size distribution can be defined by an average particle size of not greater than about 110 μm, such as not greater than about 100 μm, not greater than about 95 μm, or even not greater than about 90 μm. In still other non-limiting embodiment, the particle size distribution of the dispersoid material can be defined by an average particle size of at least about 40 μm, such as at least about 50 μm, at least about 60 μm, or even at least about 70 μm. It will be appreciated that the dispersoid material can have a particle size distribution defining an average particle size within a range between any of the minimum and maximum values noted above.

In yet another embodiment, the particle size distribution of the dispersoid material can have a first standard deviation spanning a range of particles sizes of not greater than about 15 μm. That is, for example, the first standard deviation as understood in the art will define a range of particle sizes on the curve of the particle size distribution capturing approximately 67% of the abrasive particle sizes, and more particularly, approximately 33.5% of the abrasive particle sizes on either side of the median particle size as defined by the particle size distribution curve. In another particular embodiment, the particle size should have a first standard deviation spanning a range of particles sizes of not greater than about 12 μm, such as not greater than about 11 μm, not greater than about 10 μm, not greater than about 9 μm, not greater than about 8 μm, or even not greater than about 7 μm. Still, in at least one non-limiting embodiment, the particle size distribution can have a first standard deviation spanning a range of particle sizes of the least about 1 μm, such as at least about 2 μm, at least about 3 μm, or even at least about 4 μm. It will be appreciated that the particle size distribution of the dispersoid material can have a first standard deviation spanning a range of particle sizes within a range between any of the minimum and maximum values noted above.

In accordance with an embodiment, the dispersoid material can include a salt. More particularly, the dispersoid material can include a material including at least one metal element and one halide element. More particularly, for example, the dispersoid material can include sodium chloride.

For certain embodiments herein, the dispersoid material may be removed from the mixture during formation of the bonded abrasive body. For example, in one embodiment, after formation of the abrasive article from the green body, the abrasive article may be partially or totally submerged within a solvent bath suitable for dissolving the dispersoid material. For example, in one embodiment, the solvent can include water for a dispersoid material comprising a salt. The dissolution of the dispersoid material with the finally formed body of the abrasive article may facilitate the formation of a particular type and content of porosity and the formation of a bonded abrasive article having the features of the embodiments herein.

Referring now to certain aspects of the bonded abrasive body, in one instance, the body can have a particular content of porosity that may facilitate one or more features of the embodiments herein. For example, in one embodiment the body can have a porosity of at least 30 vol % for a total volume of the bonded abrasive body. In still other instances, the body can include at least about 40 vol %, such as at least about 45 vol %, at least about 50 vol %, at least about 55 vol %, at least about 60 vol %, at least about 65 vol %, at least about 70 vol %, or even at least about 75 vol % porosity for the total volume of the bonded abrasive body. Still, in other non-limiting embodiments, the bonded abrasive body can include not greater than about 90 vol % porosity, such as not greater than about 88 vol %, not greater than about 85 vol %, not greater than about 83 vol %, or even not greater than about 80 vol % porosity for the total volume of the bonded abrasive body. It will be appreciated that the content of porosity within the bonded abrasive body may be within a range between any of the minimum and maximum percentages noted above.

Furthermore, the bonded abrasive body may include a particular type of porosity facilitating the features of the embodiments herein. For example, the body can include a porosity wherein at least a portion of the porosity is interconnected porosity defining a network of interconnected channels extending through the volume of the bonded abrasive body. In at least one embodiment, a majority of the porosity within the bonded abrasive body can be interconnected porosity. For example, in certain instances, at least about 51 vol % of the porosity can be interconnected porosity, such at least about 55 vol %, at least about 60 vol %, at least about 70 vol %, at least about 80 vol %, or even at least about 90 vol % of the total volume of porosity may be interconnected porosity. In one particular embodiment, essentially all of the porosity within the bonded abrasive body can be interconnected porosity. Still, in another non-limiting embodiment, the bonded abrasive body can have not greater than about 90 vol % of the total volume of porosity may be interconnected porosity. It will be appreciated that the bonded abrasive body can have a content of interconnected porosity within a range between any of the minimum and maximum percentages noted above.

In accordance with another embodiment, the bond material of the finally formed abrasive article can include a metal material, and more particularly, the bond material may include a transition metal element. For example, some suitable transition metal elements can include transition metal elements selected from the group of copper, tin, silver, nickel, and a combination thereof.

In accordance with one aspect, the bond material can include a bronze material, including a particular content of copper and tin that may facilitate abrasive articles having the features of the embodiments herein. In some embodiments, the bond material can include bronze including a content of copper that is less than the content of tin (for example, 40% copper and 60% tin). Still, in other embodiments, the bronze of the bond material can have a content of copper that is greater than the content of tin (for example, 60% copper and 40% tin) or even a content of copper that is substantially equal to the content of tin (for example, 50% copper and 50% tin).

For at least one embodiment, the bronze of the bond material can include a copper to tin ratio (Cu/Sn) of at least about 0.2 (by weight), such as at least about 0.23. at least about 0.25. at least about 0.28. at least about 0.3. at least about 0.33. at least about 0.35. at least about 0.38. at least about 0.4. at least about 0.43. at least about 0.45. at least about 0.48. at least about 0.5. at least about 0.53. at least about 0.55. at least about 0.58,at least about 0.6. at least about 0.63. at least about 0.65. at least about 0.68. at least about 0.7. at least about 0.73. at least about 0.75. at least about 0.78. at least about 0.8. or even at least about 0.9. Still, in another non-limiting embodiment, the bond material may include bronze having a copper to tin ratio that may be not greater than about 0.93. such as not greater than about 0.9. not greater than about 0.88. not greater than about 0.85. not greater than about 0.83. not greater than about 0.8. not greater than about 0.78. not greater than about 0.75. not greater than about 0.73. not greater than about 0.7. not greater than about 0.68. not greater than about 0.65. not greater than about 0.63. not greater than about 0.6. not greater than about 0.58. not greater than about 0.55. not greater than about 0.53. not greater than about 0.5. not greater than about 0.48. not greater than about 0.45. not greater than about 0.43. not greater than about 0.4. not greater than about 0.3. or even not greater than about 0.2. It will be appreciated that the copper to tin ratio can be based upon the weight or weight percent of each of the components, i.e., copper and tin. Moreover, it will be appreciated that the bond material, including bronze, can have a copper to tin ratio within a range between any of the minimum and maximum values noted above.

In accordance with another embodiment, the bonded abrasive body may include a particular content of bond material suitable for formation of a bonded abrasive body having the features of the embodiments herein. For example, the bonded abrasive body can have at least about 10 vol % bond material for a total volume of the bonded abrasive body. In other embodiments, the content of bond material within the bonded abrasive body can be greater, such as at least about 15 vol %, at least about 20 vol %, at least about 25 vol %, at least about 30 vol %, at least about 35 vol %, at least about 40 vol %, at least about 45 vol %, or even at least about 49 vol %. Still, in another non-limiting embodiment, the bonded abrasive body may include not greater than about 85 vol % bond material, such as not greater than about 82 vol %, not greater that about 80 vol %, not greater that about 75 vol %, not greater that about 70 vol %, or even not greater than about 65 vol % bond material for the total volume of the bonded abrasive body. It will be appreciated that the bonded abrasive body may include a content of bond material within a range between any of the minimum and maximum percentages noted above.

In accordance with a particular embodiment, the bonded abrasive body can include abrasive particles that may have a particular composition facilitating formation and performance of a bonded abrasive body according to the features of the embodiments herein. For example, the abrasive particles may include an inorganic material. More particularly, the abrasive particles may include a naturally occurring material, a synthesized material, and/or a combination thereof. For example, in certain instances, the abrasive particles may include a material from the group of oxides, carbides, nitrides, borides, oxycarbides, oxynitrides, oxyborides, carbon-containing materials, diamond, and/or a combination thereof. In certain instances, the abrasive particles may include a superabrasive material. For example, one exemplary superabrasive material can include diamond. Other types of suitable superabrasive materials can include cubic boron nitride. In at least one embodiment, the abrasive articles can consist essentially of diamond. More particularly, the abrasive particles may have some content of polycrystalline diamond.

The bonded abrasive body may include a particular content of abrasive particles facilitating the features of the bonded abrasive articles according to the embodiments herein. For example, the bonded abrasive body may include at least about 0.25 vol % abrasive particles for the total volume of the bonded abrasive body. In other instances, the content of the abrasive particles within the bonded abrasive body can be greater, such as, for example, at least about 0.5 vol %, at least about 1 vol %, at least about 2 vol %, at least about 3 vol %, at least but 4 vol %, at least about 5 vol %, at least about 6 vol %, at least about 10 vol %, at least about 15 vol %, at least about 20 vol %, at least about 25 vol %, at least about 30 vol %, at least about 35 vol %, at least about 40 vol %, or even at least about 45 vol % for the total volume of the bonded abrasive body. Still, in another non-limiting embodiment, the bonded abrasive body may include not greater than about 70 vol % abrasive particles, such as not greater than about 60 vol %, not greater than about 50 vol %, not greater than about 40 vol %, not greater than about 30 vol %, not greater than about 20 vol %, not greater than about 10 vol %, or even not greater than about 5 vol % abrasive particles for the total volume of the bonded abrasive body. It will be appreciated that the content of the abrasive particles within the bonded abrasive body may be within a range between any of the minimum and maximum percentages noted above.

In accordance with another embodiment, the abrasive particles within the bonded abrasive body may have a particular average particle size facilitating the features of the bonded abrasive particles according to the embodiments herein. For example, the abrasive particles can have an average particle size that is not greater than about 18 μm. In other instances, the abrasive particles may have a smaller average particle size, such as not greater than about 17 μm, not greater than about 16 pm, not greater than about 15 μm, not greater than about 14 μm, not greater than about 13 μm, not greater than about 12 μm, not greater than about 10 μm, not greater than about 9 μm, not greater than about 8 μm, not greater than about 7 μm, or even not greater than about 6 μm. Still, in another non-limiting embodiment, the abrasive particles can have an average particle size of at least about 0.25 μm, such as at least about 0.5 μm, at least about 0.8 μm, at least about 1 μm, at least about 2 μm, at least about 3 μm, at least about 4 μm, at least about 5 μm, or even at least about 6 μm. It will be appreciated that the abrasive particles can have an average particle size within a range between any of the minimum and maximum values noted above.

In certain instances, the bonded abrasive body may have a particular porosity facilitating the features of the bonded abrasive articles of the embodiments herein. For example, in at least one embodiment, the body can have a pore size standard deviation of not greater than about 25. Average pore size and standard deviation can be determined using a variety of known methods, such as SEM metrology performed on sample sections in which the pores have been filled with epoxy. In still another instance, the bonded abrasive body can have a pore size standard deviation that is not greater than about 16, such as not greater than about 15, not greater than about 14, not greater than about 13, not greater than about 12, not greater than about 11, not greater than about 10, not greater than about 9, not greater than about 8, or even not greater than about 7, or even not greater than about 3, or even not greater than about 2. Still, in another non-limiting embodiment, the bonded abrasive body may have a pore size variance of at least about 1, or even at least about 2. It will be appreciated that the bonded abrasive body can have a pore size standard deviation within a range between any of the minimum and maximum values noted above.

In a particular instance, the bonded abrasive bodies of the embodiments herein can have a particular average pore size facilitating the features of the abrasive particles. For example, the bonded abrasive body may have an average pore size of not greater than about 117 μm, such as not greater than about 110 μm, not greater than about 100 μm, not greater than about 95 μm, or even not greater than about 90 μm. In yet another non-limiting embodiment, the bonded abrasive body can have an average pore size of at least about 1 μm, such as at least about 5 μm, at least about 10 μm, at least about 15 μm, at least about 20 μm, at least about 30 μm, at least about 40 μm, at least about 50 μm, at least about 60 μm, at least about 70 μm, or even at least about 80 μm. It will be appreciated that the bonded abrasive body may have an average pore size within a range between any of the minimum and maximum values noted above.

In yet another aspect, the bonded abrasive body may demonstrate a particular combination of mechanical properties. For example, the body can have a ratio of wear rate ($mm^3/N$) to flexural strength (MPa) of at least about five.

Wear rate can be determined using any suitable known method, including for example using an automatic polisher/grinder such as a Struers Rotoforce-4 to abrade the surface of the abrasive body for a set time under a constant load. A number of samples can be tested at varying loads, with the samples weighed before and after each test. The volume of material loss is recorded for each different load, and plotted as volume of material loss ($mm^3$) versus applied load (N). As used herein, "wear rate," expressed in $mm^3/N$, is determined by the slope of a linear fitted curve from the volume of material loss versus applied load plot. Flexural strength (expressed in MPa) can be measured by a standard 3-point bending test as described in ASTM D790-03.

In another embodiment, the ratio of wear rate ($mm^3/N$) to flexural strength (MPa) can be at least about 5.5, at least about 6, at least about 6.5, at least about 7, at least about 7.5, at least about 8, at least about 8.5, at least about 9, at least about 9.5, or even at least about 10. Still, in yet another embodiment, the bonded abrasive body may have a ratio of wear rate ($mm^3/N$) to flexural strength (MPa) of not greater than about 40, such as not greater than about 30, or even not greater than about 20. It will be appreciated that the bonded abrasive body may have a ratio of wear rate ($mm^3/N$) to flexural strength (MPa) within a range between any of the minimum and maximum values noted above.

Moreover, in yet another aspect, the bonded abrasive body may have a particular combination of mechanical features, including for example wear rate and maximum compression load. Wear rate can be determined as described above. Maximum compression load can be determined using any suitable known method, including for example using s load frame, such as a load frame manufactured by MTS. A sample, for example a sample having an area of 50 mm×3 mm (150 $mm^2$), can be subjected to a compression test to determine the load at which the bonded abrasive body fails macroscopically. In one embodiment, for example, the bonded abrasive body may have a ratio of wear rate ($mm^3/N$) to maximum compression load (N) of at least 0.025, such as at least about 0.028, at least about 0.03, at least about 0.033, at least about 0.035, at least about 0.038, or even at least about 0.04. Still, in another embodiment, the ratio of wear rate ($mm^3/N$) to maximum compression load (N) may be not greater than about 0.2, such as not greater than about 0.1. It will be appreciated that the bonded abrasive bodies of the embodiments herein may have a ratio of wear rate ($mm^3/N$) to maximum compression load (N) within a range between any of the minimum and maximum values noted above.

In certain instances, the bonded abrasive bodies herein may be suitable for conducting material removal operations. In such operations, the process may include moving the bonded abrasive article relative to the workpiece to remove material from the workpiece. It will be appreciated that in such operations, the bonded abrasive article may be moved relative to a stationary workpiece, or alternatively, the workpiece may be moved relative to a stationary bonded abrasive article. Still, in another embodiment, the bonded abrasive article and workpiece may be moved independently and relative to each other, such as in the same direction alternative directions.

The bonded abrasive articles of the embodiments herein may be particularly suited for material removal operations on a workpiece having a Vickers hardness of at least about 1500 to about 3000 $kg/mm^2$. In certain instances, the workpieces can include hard materials, including, for example, sapphire. In at least one embodiment, the process of removing material from a workpiece can include moving the bonded abrasive article relative to a surface of a workpiece comprising sapphire. More particularly, in certain instances, the workpiece comprising sapphire may have an upper surface wherein at least a portion of the surface of a workpiece intersects a C-plane of sapphire. More particularly, the surface of the workpiece may be defined entirely by a C-plane of sapphire. In still other instances, the workpiece comprising sapphire may have an upper surface that is substantially C-plane sapphire, such that there may be some acceptable tilt angle away from the exact C-plane of the sapphire, yet the workpiece may be still characterized as "C-plane sapphire."

At least one aspect, the bonded abrasive articles of the embodiments herein demonstrate improved material removal capabilities according to a standardized sapphire grinding test using a wheel speed of 1500 rpm, a feed rate of 20-40 μm/min, and a work chuck speed 350 rpm. For example, in at least one embodiment, the abrasive article can achieve a desired surface finish of less than about 400 Angstroms according to the standardized sapphire grinding test. In other embodiments, the bonded abrasive article can achieve a desired surface finish of about 100 Angstroms or according to the standardized sapphire grinding test. Moreover, according to the standardized sapphire grinding test, the abrasive articles of the embodiments herein are capable of removing at least about 10 μm to about 30 μm of material and reducing the surface roughness by at least 50 %, based on the equation $[(R_{ao}-R_{ag})/R_{ao}]\times100\%$, wherein $R_{ao}$ represents the surface roughness of the workpiece prior to removing material, and $R_{ag}$ represents the surface roughness of the workpiece upon completing the process of removing material.

Item 1. An abrasive article comprising: a bonded abrasive body including: a bond material comprising a metal; abrasive particles contained within the bond material having an average particle size of not greater than about 20 microns; and a pore size standard deviation of not greater than about 16 microns.

Item 2. An abrasive article comprising: a bonded abrasive body including: a bond material comprising a metal; abrasive particles contained within the bond material having an average particle size of not greater than about 20 microns; and an average pore size of not greater than about 110 microns.

Item 3. An abrasive article comprising: a bonded abrasive body including: a bond material comprising a metal; abrasive particles contained within the bond material; and a ratio of wear rate ($mm^3/N$) to flexural strength (MPa) of at least about 5.

Item 4. An abrasive article comprising: a bonded abrasive body including: a bond material comprising a metal; abrasive particles contained within the bond material; and a ratio of wear rate ($mm^3/N$) to maximum compression load (N) of at least about 0.025.

Item 5. An abrasive article comprising: a bonded abrasive body including: a bond material comprising a metal; abrasive particles contained within the bond material; an average pore size of not greater than about 110 microns; and a pore size standard deviation of not greater than about 16 microns.

Item 6. The abrasive article of item 1, wherein the pore size standard deviation is not greater than about 8 microns.

Item 7. The abrasive article of any one of items 1, 2, 3, or 4, wherein the body comprises a porosity of at least about 30 vol % for a total volume of the bonded abrasive body, at least about 40 vol % or at least about 45 vol % or at least about 50 vol % or at least about 55 vol % or at least about 60 vol % or at least about 65 vol % or at least about 70 vol % or at least about 75 vol %, and not greater than about 90 vol % or not greater than about 88 vol % or not greater than about 85 vol % or not greater than about 83 vol % or not greater than about 80 vol %.

Item 8. The abrasive article of any one of items 1, 2, 3, or 4, wherein the body comprises porosity, and at least a portion of the porosity is interconnected porosity defining a network of interconnected channels extending through the body, at least a majority of the porosity of the body is interconnected porosity, wherein at least about 51 vol %, of the total porosity is interconnected porosity, wherein at least about 55 vol % of the total porosity is interconnected porosity or at least about 60 vol % or at least about 70 vol % or at least about 80 vol % or at least about 90 vol %, wherein essentially all of the porosity is interconnected porosity, wherien not greater than about 90 vol % of the porosity is interconnected porosity.

Item 9. The abrasive article of any one of items 1, 2, 3, or 4, wherein the bond material comprises a transition metal element, wherein the bond material comprises a transition metal element selected from the group consisting of copper, tin, silver, nickel, and a combination thereof.

Item 10. The abrasive article of any one of items 1, 2, 3, or 4, wherein the bond material comprises bronze including copper (Cu) and tin (Sn), wherein the bronze comprises a content of copper that is not less than a content of tin, wherein the bronze comprises a content of copper that is greater than a content of tin, wherein the bronze comprises a copper/tin ratio (Cu/Sn) of at least about 0.2 or at least about 0.23 or at least about 0.25 or at least about 0.28 or at least about 0.3 or at least about 0.33 or at least about 0.35 or at least about 0.38 or at least about 0.4 or at least about 0.43 or at least about 0.45 or at least about 0.48 or at least about 0.5 or at least about 0.53 or at least about 0.55 or at least about 0.58 or at least about 0.6 or at least about 0.63 or at least about 0.65 or at least about 0.68 or at least about 0.7 or at least about 0.73 or at least about 0.75 or at least about 0.78 or at least about 0.8 or at least about 0.9.

Item 11. The abrasive article of any one of items 1, 2, 3, or 4, wherein the bond material comprises bronze including copper (Cu) and tin (Sn), wherein the bronze comprises a copper/tin ratio (Cu/Sn) of not greater than about 0.93 or not greater than about 0.9 or not greater than about 0.88 or not greater than about 0.85 or not greater than about 0.83 or not greater than about 0.8 or not greater than about 0.78 or not greater than about 0.75 or not greater than about 0.73 or not greater than about 0.7 or not greater than about 0.68 or not greater than about 0.65 or not greater than about 0.63 or not greater than about 0.6 or not greater than about 0.58 or not greater than about 0.55 or not greater than about 0.53 or not greater than about 0.5 or not greater than about 0.48 or not greater than about 0.45 or not greater than about 0.43 or not greater than about 0.4 or not greater than about 0.3 or not greater than about 0.2.

Item 12. The abrasive article of any one of items 1, 2, 3, or 4, wherein the bonded abrasive body comprises at least about 10 vol % of the bond material for the total volume of the bonded abrasive body or at least about 15 vol % or at least about 20 vol % or at least about 25 vol % or at least about 30 vol % or at least about 35 vol % or at least about 40 vol % or at least about 45 vol % or at least about 49 vol %.

Item 13. The abrasive article of any one of items 1, 2, 3, or 4, wherein the bonded abrasive body comprises not greater than about 85 vol % of the bond material for the total volume of the bonded abrasive body or not greater than about 82 vol % or not greater than about 80 vol % or not greater than about 75 vol % or not greater than about 70 vol % or not greater than about 65 vol %.

Item 14. The abrasive article of any one of items 1, 2, 3, or 4, wherein the abrasive particles comprise an inorganic material, wherein the abrasive particles comprise a naturally occurring material, wherein the abrasive particles comprise a synthesized material, wherein the abrasive particles comprise a material selected from the group consisting of oxides, carbides, nitrides, borides, oxycarbides, oxynitrides, oxyborides, carbon-containing materials, diamond, and a combination thereof.

Item 15. The abrasive article of any one of items 1, 2, 3, or 4, wherein the abrasive particles comprise a superabrasive material, wherein the abrasive particles comprise a diamond, wherein the abrasive particles comprise cubic boron nitride, wherein the abrasive particles consist essentially of diamond, wherein the abrasive particles comprise having a content of polycrystalline diamond.

Item 16. The abrasive article of any one of items 1, 2, 3, or 4, wherein the bonded abrasive body comprises at least about 0.25 vol % or at least about 0.5 vol % or at least about 1 vol % or at least about 2 vol % or at least about 3 vol % or at least about 4 vol % or at least about 5 vol % or at least about 6 vol %, 10 vol % abrasive particles for the total volume of the bonded abrasive body, at least about 15 vol % or at least about 20 vol % or at least about 25 vol % or at least about 30 vol % or at least about 35 vol % or at least about 40 vol % or at least about 45 vol %.

Item 17. The abrasive article of any one of items 1, 2, 3, or 4, wherein the bonded abrasive body comprises not greater than about 70 vol % abrasive particles for the total volume of the bonded abrasive body, not greater than about 60 vol % or not greater than about 50 vol % or not greater than about 40 vol % or not greater than about 30 vol % or not greater than about 20 vol % or or not greater than about 10 vol %.

Item 18. The abrasive article of any one of items 1, 2, 3, or 4, wherein the abrasive particles have an average particle size of not greater than about 18 microns or not greater than about 17 microns or not greater than about 16 microns or not greater than about 15 microns or not greater than about 14 microns or not greater than about 13 microns or not greater than about 12 microns or not greater than about 10 microns or not greater than about 9 microns or not greater than about 8 microns or not greater than about 7 microns or or not greater than about 6 microns.

Item 19. The abrasive article of any one of items 1, 2, 3, or 4, wherein the abrasive particles have an average particle size of at least about 0.25 microns or at least about 0.5 microns or at least about 0.8 microns or at least about 1 micron or at least about 2 microns or at least about 3 microns or at least about 4 microns or at least about 5 microns, or at least about 6 microns.

Item 20. The abrasive article of any one of items 1, 2, 3, or 4, wherein the body is configured to grind sapphire, wherein the body is configured to grind C-plane sapphire, wherein the body is configured for grinding of materials having a Vickers hardness of at least about 1500-3000 $kg/mm^2$ Item 21. The abrasive article of any one of items 2, 3, or 4, wherein the body comprises a pore size variance of not greater than about 25 or not greater than about 16 or not greater than about 15 or not greater than about 14 or not greater than about 13 or not greater than about 12 or not greater than about 11 or not greater than about 10 or not greater than about 9 or not greater than about 8 or not greater than about 7.

Item 22. The abrasive article of item 1, wherein the body comprises a pore size variance of not greater than about 15 or not greater than about 14 or not greater than about 13 or not greater than about 12 or not greater than about 11 or not greater than about 10 or not greater than about 9 or not greater than about 8 or not greater than about 7.

Item 23. The abrasive article of any one of items 2, 3, or 4, wherein the body comprises a pore size variance of at least about 1, or at least about 2.

Item 24. The abrasive article of item 1, wherein the body comprises a pore size variance of at least about 1, or at least about 2.

Item 25. The abrasive article of any one of items 1, 3, or 4, wherein the body comprises an average pore size of not greater than about 110 microns or not greater than about 100 microns or not greater than about 95 microns or not greater than about 90 microns.

Item 26. The abrasive article of item 2, wherein the body comprises an average pore size of not greater than about 100 microns or not greater than about 95 microns or not greater than about 90 microns.

Item 27. The abrasive article of any one of items 1, 3, or 4, wherein the body comprises an average pore size of at least about 1 micron or at least about 5 microns or at least about 10 microns or at least about 15 microns or at least about 20 microns or at least about 30 microns or 40 microns or at least about 50 microns or at least 60 microns or at least about 70 microns.

Item 28. The abrasive article of item 2, wherein the body comprises an average pore size of at least about 1 micron or at least about 5 microns or at least about 10 microns or at least about 15 microns or at least about 20 microns or at least about 30 microns or at least about 40 microns or at least about 50 microns or at least 60 microns or at least about 70 microns.

Item 29. The abrasive article of any one of items 1, 2, or 4, wherein the body comprises a ratio of wear rate ($mm^3/N$) to flexural strength (MPa) of at least about 5 or at least about 5.5 or at least about 6 or at least about 6.5 at least about 7 or at least about 7.5 or at least about 8 or at least about 8.5 or at least about 9 or at least about 9.5 or at least about 10.

Item 30. The abrasive article of any one of items 1, 2, or 4, wherein the body comprises a ratio of wear rate ($mm^3/N$) to flexural strength (MPa)of not greater than about 40 or not greater than about 30 or not greater than about 20.

Item 31. The abrasive article of item 3, wherein the body comprises a ratio of wear rate ($mm^3/N$) to flexural strength (MPa) of at least about 5.5 or at least about 6 or at least about 6.5 at least about 7 or at least about 7.5 or at least about 8 or at least about 8.5 or at least about 9 or at least about 9.5 or at least about 10.

Item 32. The abrasive article of item 3, wherein the body comprises a ratio of wear rate ($mm^3/N$) to flexural strength (MPa) of not greater than about 40 or not greater than about 30 or not greater than about 20.

Item 33. The abrasive article of any one of items 1, 2, or 3, wherein the body comprises a ratio of wear rate ($mm^3/N$) to maximum compression load (N) of at least about 0.025 or at least about 0.028 or at least about 0.03 or at least about 0.033 or at least about 0.035 or at least about 0.038 or at least about 0.04.

Item 34. The abrasive article of any one of items 1, 2, or 3, wherein the body comprises a ratio of wear rate ($mm^3/N$) to maximum compression load of not greater than about 0.2 or not greater than about 0.1.

Item 35. The abrasive article of item 4, wherein the body comprises a ratio of wear rate ($mm^3/N$) to maximum compression load of at least about 0.028 or at least about 0.03 or at least about 0.033 or at least about 0.035 or at least about 0.038 or at least about 0.04.

Item 36. The abrasive article of item 4, wherein the body comprises a ratio of wear rate ($mm^3/N$) to maximum compression load of not greater than about 0.2 or not greater than about 0.1.

Item 37. A method of removing material from a workpiece comprising: moving a bonded abrasive article relative to the workpiece to remove material from the workpiece, wherein the workpiece comprises a wafer having a diameter of about 4" to about 6", a hardness of at least about 1500 $kg/mm^2$ and also wherein moving the bonded abrasive article comprises removing at least about 10 μm of material and reducing the surface roughness by at least about 50% based on the equation $[(R_{ao}-R_a d/R_{ao}]\times 100\%$, wherein $R_{ao}$ represents the surface roughness of the workpiece prior to removing material, and $R_{ag}$ represents the surface roughness of the workpiece upon completing the process of removing material.

Item 38. The method of item 37. wherein the workpiece comprises sapphire, wherein moving comprises moving the bonded abrasive article relative to a surface of a workpiece, wherein at least a portion of the surface of the workpiece intersects a C-plane of sapphire, wherein the surface of the workpiece is defined by a C-plane of sapphire, wherein the surface of the workpiece is substantially C-plane sapphire.

Item 39. The method of item 37, wherein the bonded abrasive comprises a bond material comprising a metal.

Item 40. The method of item 37, wherein the bonded abrasive comprises a body including abrasive particles having an average particle size of not greater than about 20 microns.

Item 41. The method of item 37, wherein the bonded abrasive comprises a body having a pore size variance of not greater than about 25 or not greater than about 16 or or not greater than about 8.

Item 42. The method of item 37, wherein the bonded abrasive comprises a body having an average pore size of not greater than about 110 microns.

Item 43. The method of item 37, wherein the bonded abrasive comprises a body having a ratio of wear rate ($mm^3/N$) to flexural strength (MPa) of at least about 5.

Item 44. The method of item 37, wherein the bonded abrasive comprises a body having a ratio of wear rate ($mm^3/N$) to maximum compression load (N) of at least about 0.025.

Item 45. A method of forming a bonded abrasive comprising: providing a mixture comprising a bond material, abrasive particles and a dispersoid material, wherein the dispersoid material defines a narrow particle size distribution; and forming the mixture to form a bonded abrasive article.

Item 46. The method of item 45, wherein the narrow particle size distribution is defined by an average particle size of not greater than about 110 microns or not greater than about 100 microns or not greater than about 95 microns or not greater than about 90 microns.

Item 47. The method of item 45, wherein the narrow particle size distribution is defined by an average particle size of at least about 40 microns or at least about 50 microns or at least 60 microns or at least about 70 microns.

Item 48. The method of item 45, wherein the narrow particle size distribution has a first standard deviation spanning a range of particle sizes of not greater than 15 microns or not greater than about 12 or not greater than about 11 or not greater than about 10 or not greater than about 9 or not greater than about 8 or not greater than about 7.

Item 49. The method of item 45, wherein the narrow particle size distribution has a first standard deviation spanning a range of particle sizes of at least about 1.

Item 50. The method of item 45, wherein the dispersoid material comprises a salt.

Item 51. The method of item 45, wherein the dispersoid material is removed during forming of the mixture to form the bonded abrasive body.

Item 52. The method of item 45, wherein the dispersoid material is dissolved from the body and forms porosity within the body of the bonded abrasive body.

Item 53. The method of item 45, wherein the body comprises a ratio of wear rate ($mm^3/N$) to flexural strength (MPa) of at least about 5.

Item 54. The method of item 45, wherein the body comprises a ratio of wear rate ($mm^3/N$) to maximum compression load (N) of at least about 0.025.

Item 55. The method of item 45, wherein the body comprises a porosity of at least about 30 vol % for a total volume of the bonded abrasive body.

Item 56. The method of item 45, wherein the bond material comprises a transition metal element.

Item 57. The method of item 45, wherein the bond material comprises bronze including copper (Cu) and tin (Sn).

Item 58. The method of item 45, wherein the abrasive particles comprise a superabrasive material.

Item 59. An abrasive article comprising: a bonded abrasive body including: a bond material comprising a metal; abrasive particles contained within the bond material; wherein the bonded abrasive body has a power spike of not greater than about 50% for a standardized sapphire grinding test.

Item 60. The abrasive article of item 59 in which the abrasive body further comprises: an average pore size of not greater than about 110 microns; and a pore size standard deviation of not greater than about 16 microns.

Item 61. The abrasive article of any one of items 59-60 in which the ratio of peak power to average power during a standardized sapphire grinding test is 1.5 or less.

Many different aspects and embodiments are possible. Some of those aspects and embodiments are described below. After reading this specification, skilled artisans will appreciate that those aspects and embodiments are only illustrative and do not limit the scope of the present invention. Embodiments can be in accordance with any one or more of the items as listed below.

EXAMPLES

Three samples of abrasive articles were prepared; a first sample C1 was prepared using conventional techniques, while sample S1 and sample S2 were prepared according to embodiments herein. As summarized in Table 1 below, conventional sample Cl was prepared using a dispersoid material having a size range of 70-210 μm, while samples S1 and S2 were prepared using a dispersoid material having a size range of 70-95 μm. Samples C1 and S1 both included the same percentage of abrasive particles (vol % of the total volume of the bonded abrasive body) and both included abrasive particles of diamond having an average particle size of approximately 6-12 μm. Sample S2 used finer abrasive particles having an average particle size of approximately 5 μm, but comprising the same overall vol % of the total volume of the bonded abrasive body as in C1. Bronze (a 50/50 ratio of copper to tin by weight) was used as the bond material for all samples.

TABLE 1

| Sample | Soluble filler size [microns] | Diamond (abrasive) size [microns] | Bond material | Finish (Å) |
|---|---|---|---|---|
| C1 | 70-210 | 6-12 | bronze | 1000 |
| S1 | 70-95 | 6-12 | bronze | 500-600 |
| S2 | 70-95 | 4-8 | bronze | 350-500 |

Figure 2:
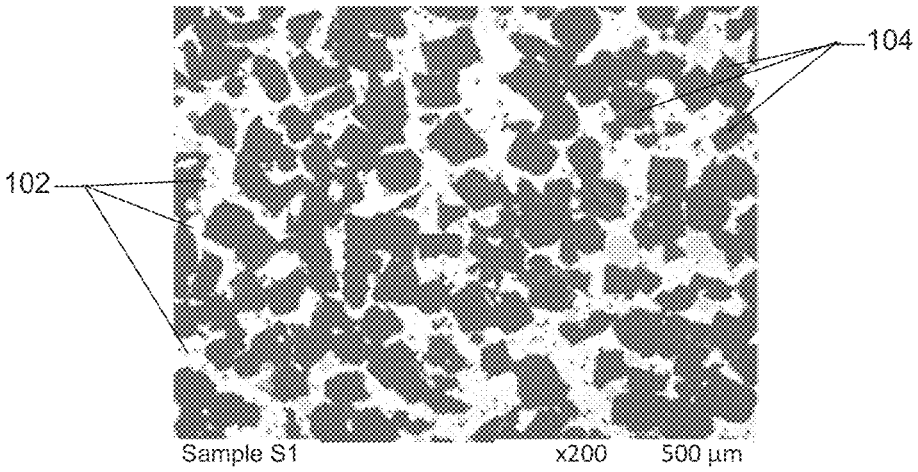
FIG. 2 includes an SEM photograph of an abrasive article according to embodiments herein.

FIG. 1 shows an SEM photograph of the bonded abrasive of sample C1. FIG. 2 shows an SEM photograph of the bonded abrasive of sample S1. In the SEM images of FIGS. 1 and 2, the light areas 102 are the bond/abrasive particles and the dark areas 104 are the porosity. The average particle size for the soluble filler of samples S1 and S2 were smaller than in the conventional sample C1 and the average pore size distribution was narrower, resulting in a smaller standard deviation of pore sizes than C1. as can be seen by comparing FIGS. 1 and 2.

During sample testing, conventional sample C1 was unable to grind (remove material from) a workpiece of C-plane sapphire. Sample Si was able to grind the C-plane sapphire workpiece and produced a sapphire surface with a finish of about 500 to 600 Angstroms. Sample S2 produced a sapphire surface with a finish of about 350 to 500 Angstroms.

Figure 3:
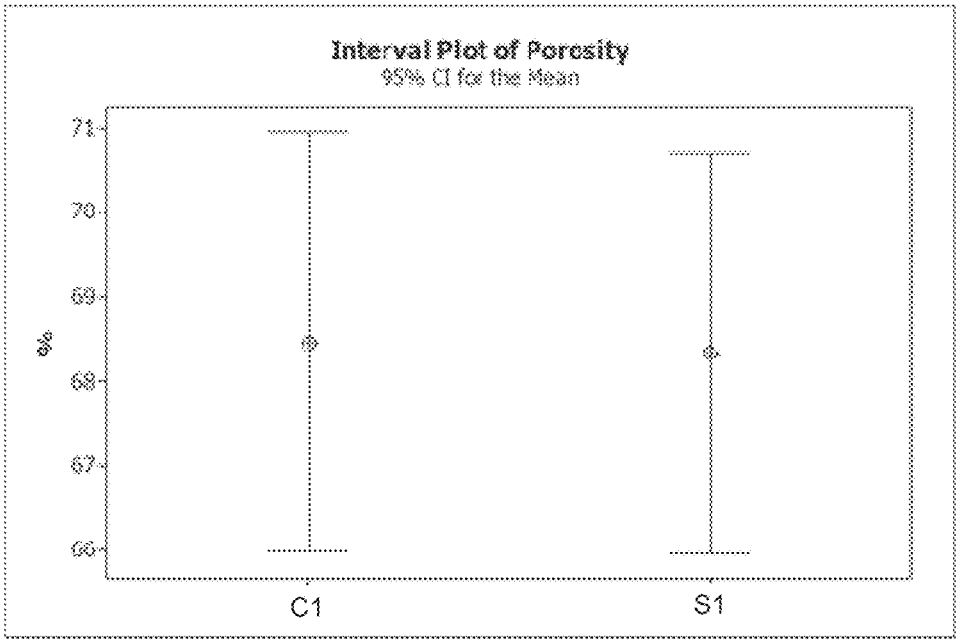
FIG. 3 includes a plot of the total porosity for a conventional abrasive article and for an abrasive article according to an embodiment herein.
Figure 4:
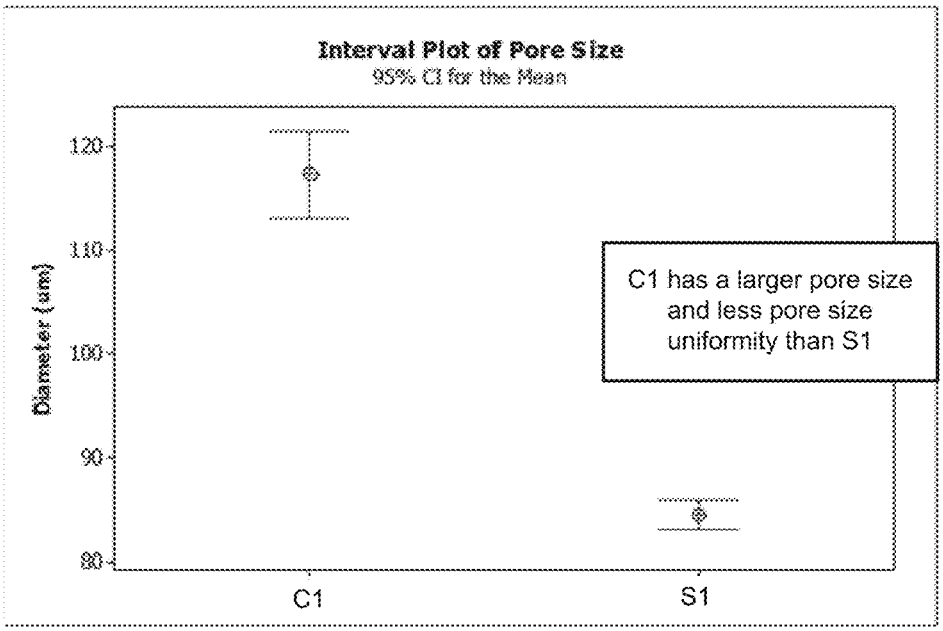
FIG. 4 includes a plot showing the pore size for the two samples of FIG. 3.

FIG. 3 illustrates an interval plot of the total porosity for samples C1 and S1. FIG. 4 illustrates an interval plot showing the average pore size for the two samples. As seen in FIG. 4, the pore sizes were different; with C1 having a mean pore size of about 117 μm while S1 had a mean pore size of about 84 μm. FIG. 4 also shows that sample C1 had less pore size uniformity (a larger range of pore sizes) than S1.

Figure 5:
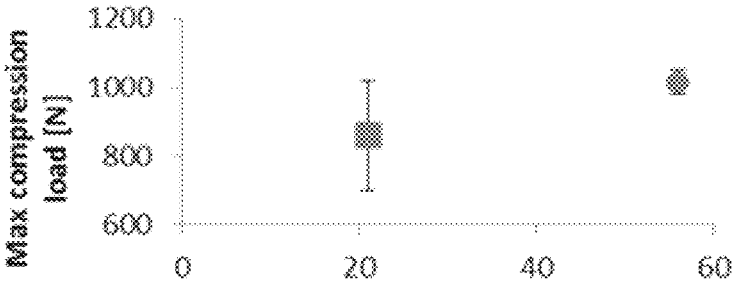
FIG. 5 includes a plot of wear rate ($mm^3/N$) to flexural strength (MPa) for the two samples of FIG. 3.
Figure 6:
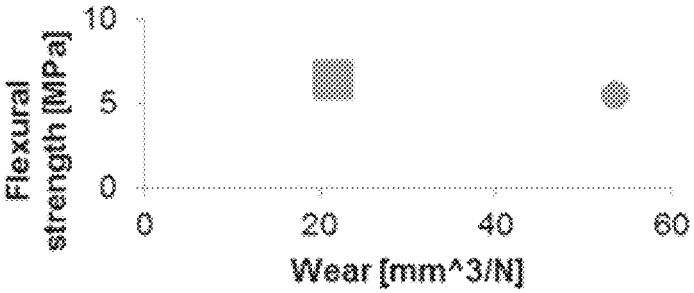
FIG. 6 includes a plot of wear rate ($mm^3/N$) to maximum compressive load (N) for the two samples of FIG. 3.

FIG. 5 illustrates a plot of wear rate ($mm^3/N$) to flexural strength (MPa) for samples C1 and S1. The ratio of wear rate ($mm^3/N$) to flexural strength (MPa) for conventional sample C1 is about 4.0. while the ratio for sample S1 is about 11. FIG. 6 illustrates a plot of wear rate ($mm^3/N$) to maximum compressive load (N) for samples C1 and S1. The ratio of wear rate ($mm^3/N$) to maximum compressive load (N) for conventional sample C1 is about 0.023. while the ratio for sample S1 is about 0.054.

For certain embodiments herein, the bonded abrasive body is self-dressing. In other words, such bonded abrasive bodies will not require dressing or additional conditioning during use due to an unacceptable increase power consumption during a grinding operation resulting from grinding debris loading the grinding face of the abrasive body. In some instances, a bonded abrasive body will have a power spike of not greater than 50% during a standardized sapphire grinding test as described herein. In some instances, the ratio of peak power to average power during such a standardized sapphire grinding test is 1.5 or less when using a bonded abrasive body according to embodiments herein.

The foregoing embodiments represent a departure from the state-of-the-art. Notably, the bonded abrasive bodies of the embodiments herein include a combination of features not previously recognized in the art and facilitate performance improvements. Such features can include, but is not limited to, particular abrasive particles types and sizes, particular size and content of porosity, bond material and content, and a combination thereof. The bonded abrasive bodies of the embodiments herein have demonstrated remarkable and unexpected improvements over state-of-the-art bonded abrasive bodies.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. An abrasive article comprising:

a bonded abrasive body including:

a bond material comprising a metal;

abrasive particles contained within the bond material having an average particle size of not greater than about 20 microns;

a porosity of at least about 30 vol % and not greater than about 90 vol % for a total volume of the bonded abrasive body;

an average pore size of at least about 1 micron and not greater than about 117 microns; and a pore size standard deviation of not greater than about 16 microns, wherein the body comprises a ratio of wear rate ($mm^3/N$) to flexural strength (MPa) of at least about 5 and not greater than about 40.

2. The abrasive article of claim 1, wherein the pore size standard deviation is not greater than about 8 microns.

3. The abrasive article of claim 1, wherein the body comprises a porosity of at least about 70 vol % for a total volume of the bonded abrasive body.

4. The abrasive article of claim 1, wherein the body comprises porosity, and at least a portion of the porosity is interconnected porosity defining a network of interconnected channels extending through the body.

5. The abrasive article of claim 1, wherein the bond material comprises bronze including copper (Cu) and tin (Sn), and wherein the bronze comprises a copper/tin ratio (Cu/Sn) of at least about 0.2 and not greater than about 0.93.

6. The abrasive article of claim 1, wherein the bonded abrasive body comprises at least about 10 vol % and not greater than about 85 vol % of the bond material for the total volume of the bonded abrasive body.

7. The abrasive article of claim 1, wherein the abrasive particles comprise a superabrasive material.

8. The abrasive article of claim 1, wherein the body comprises a pore size variance of at least about 1 and not greater than about 25.

9. The abrasive article of claim 1, wherein the body comprises an average pore size of at least about 60 microns.

10. An abrasive article comprising:

a bonded abrasive body including:

at least about 15 vol. % metal bond material for a total volume of the bonded abrasive body;

abrasive particles contained within the bond material having an average particle size of not greater than about 20 microns;

a porosity of at least about 30 vol % and not greater than about 90 vol % for a total volume of the bonded abrasive body;

an average pore size of at least about 1 micron and not greater than about 100 microns; and a pore size standard deviation of not greater than about 16 microns, wherein the body comprises a ratio of wear rate ($mm^3/N$) to flexural strength (MPa) of at least about 5 and not greater than about 40.

11. The abrasive article of claim 10, wherein the body comprises a porosity of at least about 70 vol % for a total volume of the bonded abrasive body.

12. The abrasive article of claim 10, wherein the body comprises porosity, and at least about 51 vol. % of the porosity is interconnected porosity defining a network of interconnected channels extending through the body.

13. The abrasive article of claim 10, wherein the metal bond material comprises bronze including copper (Cu) and tin (Sn), and wherein the bronze comprises a copper/tin ratio (Cu/Sn) of at least about 0.2 and not greater than about 0.93.

14. The abrasive article of claim 10, wherein the body comprises a pore size variance of at least about 1 and not greater than about 25.

15. The abrasive article of claim 10, wherein the body comprises an average pore size of at least about 60 microns and not greater than about 90 microns.

* * * * *